United States Patent [19]

Nagai et al.

[11] Patent Number: 4,831,838

[45] Date of Patent: May 23, 1989

[54] DOUBLE AIR-FUEL RATIO SENSOR SYSTEM CARRYING OUT LEARNING CONTROL OPERATION

[75] Inventors: Toshinari Nagai, Susono; Takatoshi Masui; Yasushi Satou, both of Mishima; Toshiyasu Katsuno, Susono, all of Japan

[73] Assignee: Toyota Jidosha Kabushiki Kaisha, Aichi, Japan

[21] Appl. No.: 124,412

[22] Filed: Nov. 17, 1987

Related U.S. Application Data

[63] Continuation of Ser. No. 889,413, Jul. 25, 1986, abandoned.

[30] Foreign Application Priority Data

Jul. 31, 1985 [JP] Japan ..... 60-167425
Jul. 31, 1985 [JP] Japan ..... 60-167426

[51] Int. Cl.[4] ..... F01N 3/20; F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,561,403 | 12/1985 | Oyama et al. | 123/489 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 135343 | 8/1983 | Japan . |
| 152147 | 9/1983 | Japan . |
| 58-150038 | 9/1983 | Japan . |
| 58-150039 | 9/1983 | Japan . |
| 59-32644 | 2/1984 | Japan . |
| 57-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors including an air-fuel ratio correction amount. Also, a learning correction amount is calculated so that a mean value of the air-fuel ratio correction amount is brought close to a reference value. The actual air-fuel ratio is further adjusted in accordance with the learning correction amount.

32 Claims, 22 Drawing Sheets

LEAN
RICH
A/F1

TDR1
CDLY1
0
t1
t2
t3
t4
t5
t6
t7
t8
TDL1
A/F1'
(F1)

TDR1
(-TDL1)
LEAN
RICH
TDR1

KIR
FAF1
RSL
RSR
KIL

| Fig. 6A | Fig. 6B | Fig. 6C |
|---|---|---|

V
1
0
V1
VR1
RICH
LEAN
TDR1
(-TDL1)
F1
KIR
RSL
FAF1
RSR
KIL
V2
VR2
LEAN
RICH
(-TDL2)
TDR2
F2
KI2
RS2
FAF2
RS2
KI2
RS2

| Fig. 9 A | Fig. 9 B |
|---|---|

V
1
0
V1
VR1

RICH
LEAN

TDR1
(-TDL1)
F1

KIR
RSL
FAF1
RSR
KIL

V
1
0
V2
VR2

LEAN
RICH (-TDL2)
TDR2
F2

MAX
RSR
MIN

MAX
RSL
MIN

Fig. 14A $V_1$

LEAN
RICH
A/F1

TDL1
CDLY1
0
t1 t2
t3
t4
t5 t6 t7
t8
TDR1

(-TDR1)
LEAN
RICH
TDL1
(-TDR1)
A/F1'
(F1)

KIR
KIL
FAF1
RSL
RSR

DOUBLE AIR-FUEL RATIO SENSOR SYSTEM CARRYING OUT LEARNING CONTROL OPERATION

This is a continuation of application Ser. No. 889,413 filed July 25, 1986, now abandoned.

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $o_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, the air-fuel ratio correction coefficient FAF may be greatly deviated from a reference value such as 1.0 due to individual differences in the characteristics of the parts of the engine, individual changes caused by aging, environmental changes, and the like. For example, when driving at a high altitude (above sea level), the air-fuel ratio correction coefficient FAF is remarkably reduced, thereby obtaining an optimum air-fuel ratio such as the stoichiometric air-fuel ratio. In this case, when the engine is switched from an air-fuel ratio feedback control (closed-loop control) by the upstream-side and downstream-side $O_2$ sensors to an open-loop control, the air-fuel ratio correction coefficient FAF is made the reference value (=1.0), thereby causing an overrich or overlean condition in the controlled air-fuel ratio, and thus deteriorating the fuel consumption, the drivability, and the condition of the exhaust emissions such as HC, C, and $NO_X$, since the air-fuel ratio correction coefficient. FAF (=0.1) during an open-loop control is, in this case, not an optimum level.

SUMMARY OF THE INVENTION

It is an object of the present invention to provide a double air-fuel ratio sensor system in an internal combustion engine with which the fuel consumption, the drivability, and the exhaust emission characteristics are improved during an open-loop control.

According to the present invention, in a double air-fuel ratio sensor system including two $O_2$ sensors upstream and downstream of a catalyst converter provided in an exhaust passage, an actual air-fuel ratio is adjusted by using the output of the upstream-side $O_2$ sensor and the output of the downstream-side $O_2$ sensor. In this system, an air-fuel ratio correction coefficient FAF is calculated in accordance with the output of the upstream-side $O_2$ sensor, and a learning correction amount FGHAC is calculated so that a mean value of the air-fuel ratio correction coefficient FAF is brought close to the reference value. Thus, the actual air-fuel ratio is further adjusted in accordance with the learning correction amount FGHAC. In this system, during a closed-loop control by the upstream-side $O_2$ sensor, the center of the air-fuel ratio correction coefficient FAF is changed in the vicinity of the reference value, so that the learning correction amount FGHAC absorbs the deviation of the base air-fuel ratio from the stoichiometric air-fuel ratio. On the other hand, during an open-loop control, the air-fuel ratio correction coefficient FAF is made the reference value (=0.1), but, in this case, there is no substantial difference in the air-fuel ratio correction amount FAF plus the learning correction amount FGHAC (FAF+FGHAC), between the closed-loop control and the open-loop control.

BRIEF DESCRIPTION OF THE DRAWINGS

The present invention will be more clearly understood from the description as set forth below with reference to the accompanying drawings, wherein:

FIGS. 3, 3A—3C, 4, 6, 6A—6C, 7, 9, 9A, 9B, 10, 12, 15, and 17 are flow charts showing the operation of the control circuit of FIG. 2;

FIGS. 14A through 14E are timing diagrams explaining the effect of the present invention.

DESCRIPTION OF THE PREFERRED EMBODIMENTS

Figure 1:
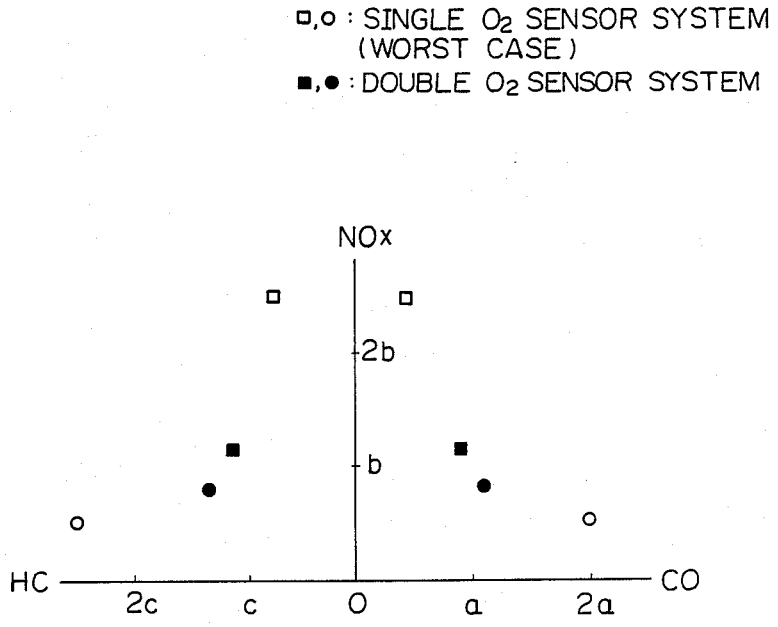
FIG. 1 is a graph showing the emission characteristics of a single $O_2$ sensor system and a double $O_2$ sensor system.
Figure 2:
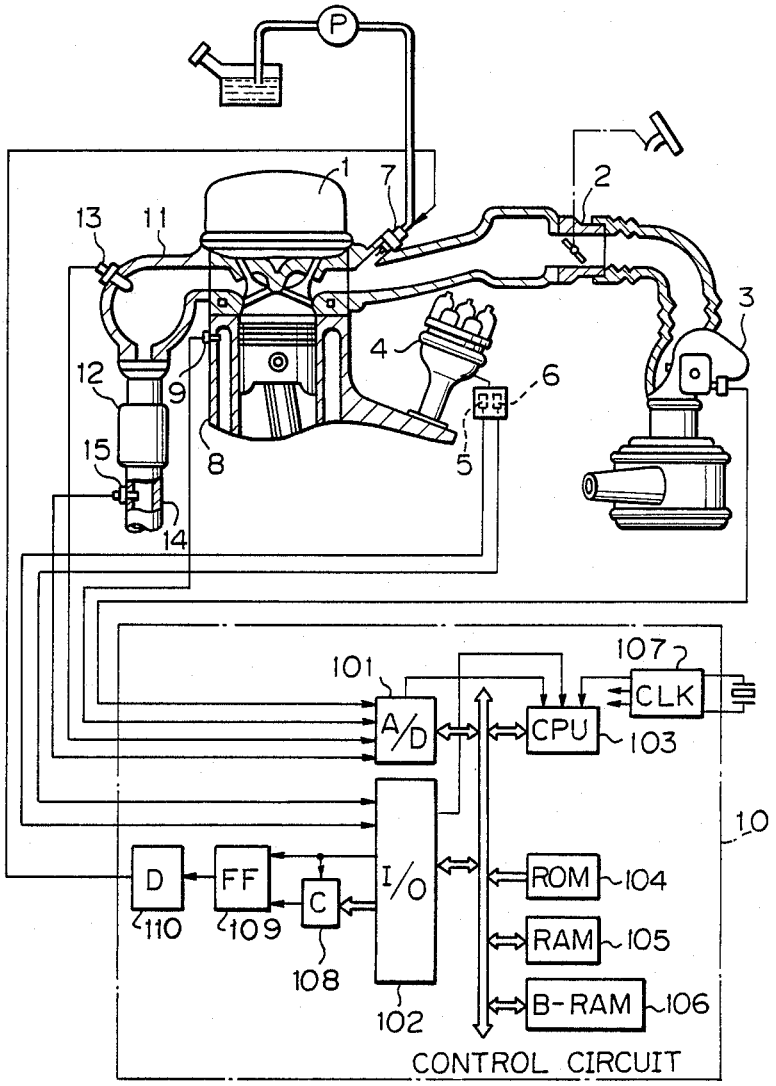
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30°CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature date THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA., i.e., at every pulse signal of the crank angle sensor 6, and is then stored in the RAM 105.

The operation of the control circuit 10 of FIG. 2 will be now explained.

Figure 3A:
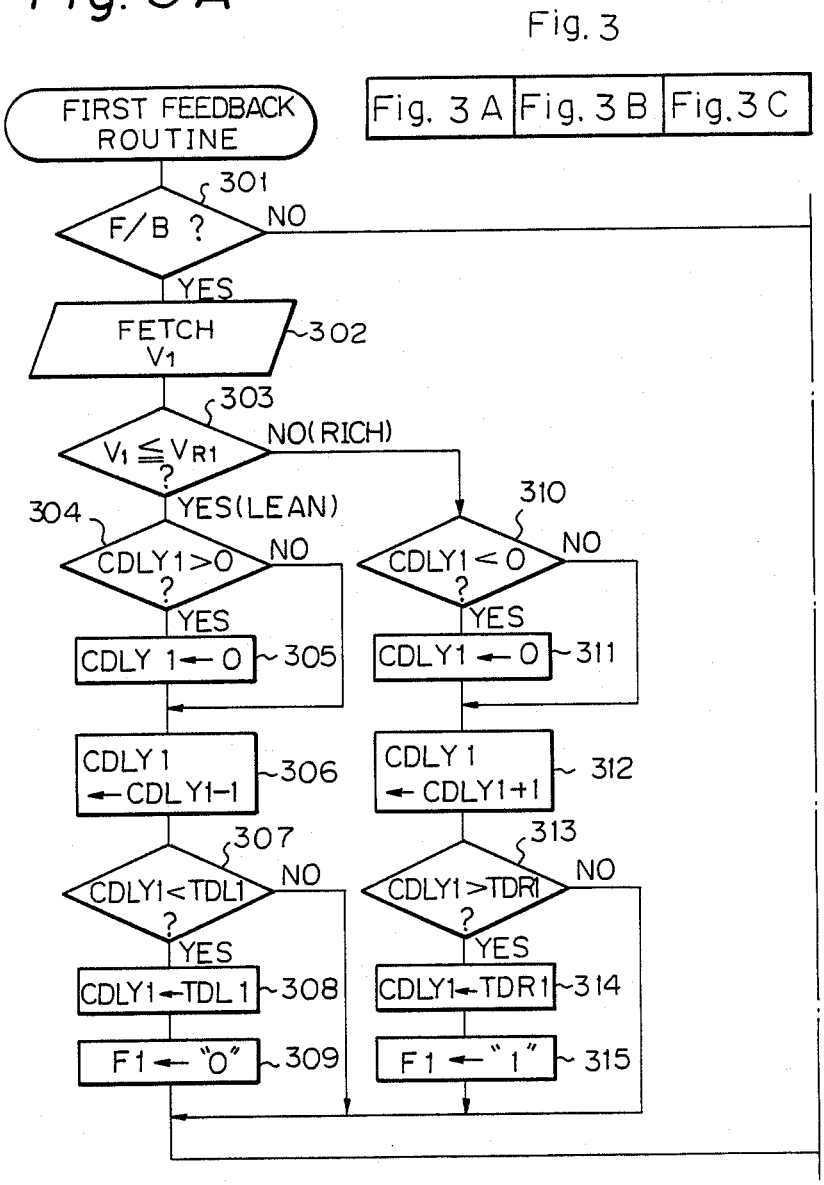
Figure 3B:
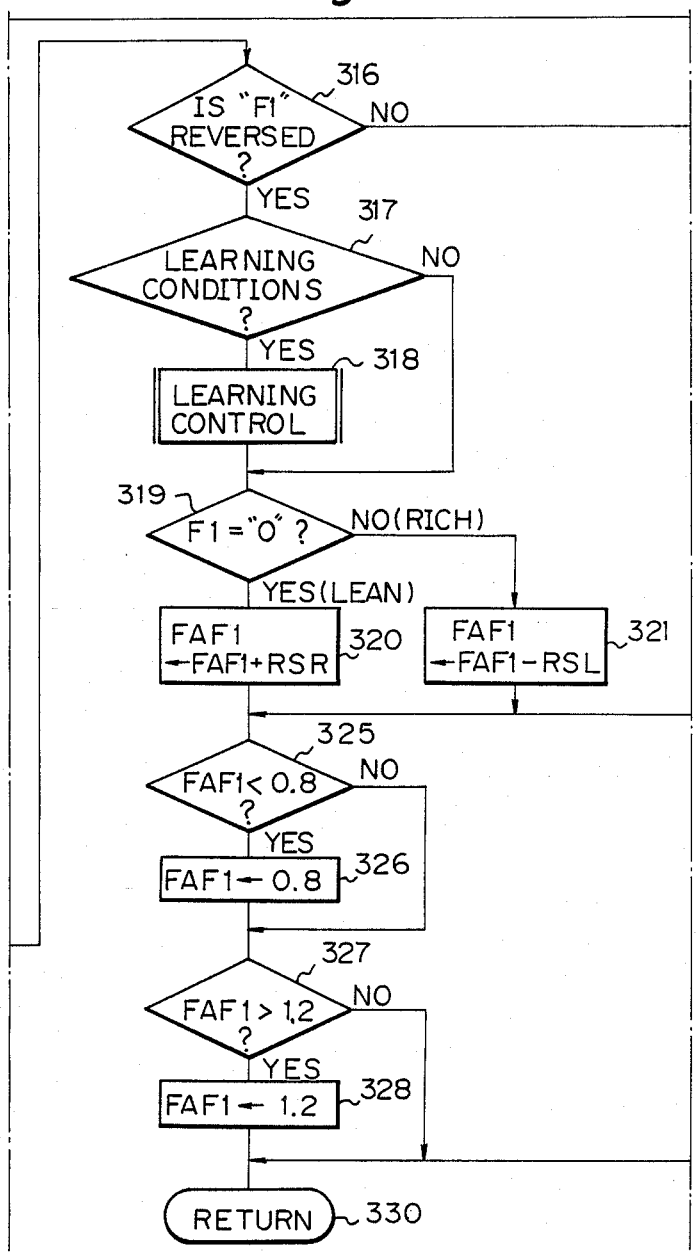
Figure 3C:
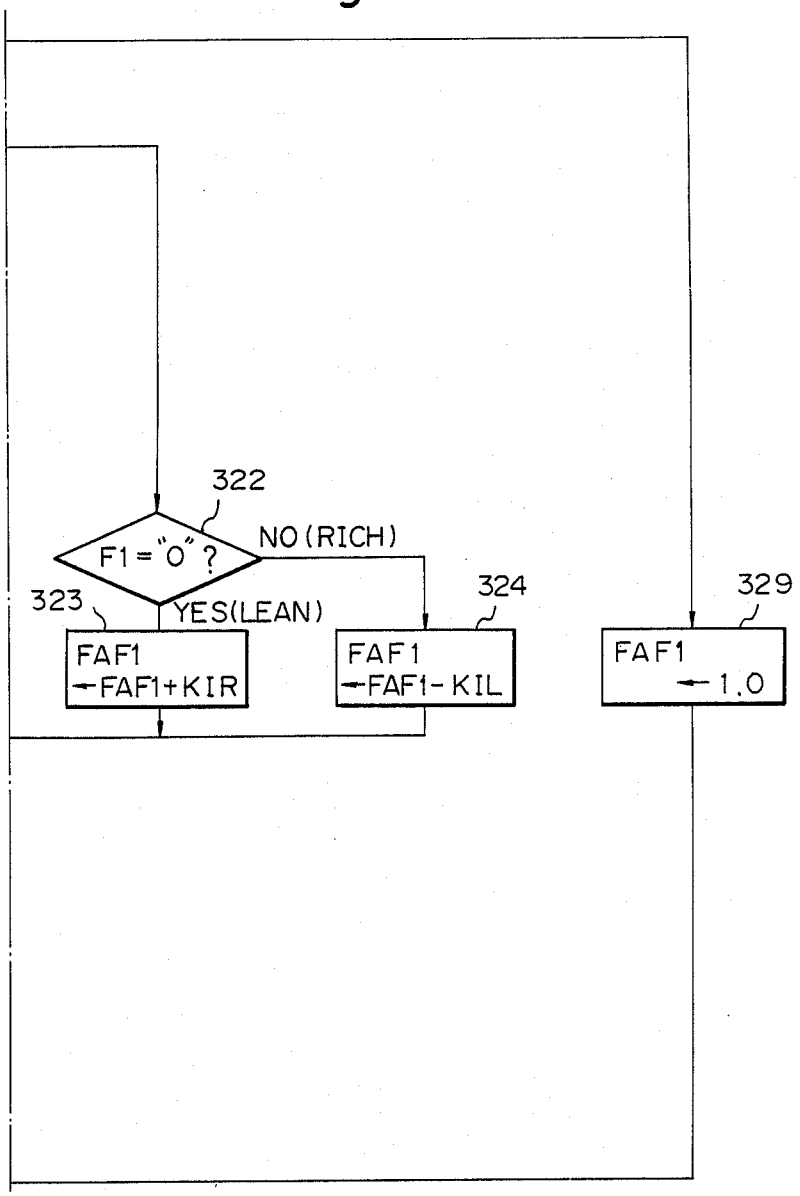

FIG. 3 is a routine for calculating a first air-fuel ratio feedback correction mount FAF1 in accordance with the output of the upstream-side $O_2$ sensor 13 executed at every predetermined time period such as 4 ms.

At step 301, it is determined whether or not all the feedback control (closed-loop control) conditions by the upstream-side $O_2$ sensor 13 are satisfied. The feedback control conditions are as follows:

(i) the engine is not in a starting state;

(ii) the collant temperature THW is higher than 50° C.;

(iii) the power fuel incremental amount FPOWER is 0; and (iv) the upstream-side $O_2$ sensor 13 is in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 329, in which the amount FAF1 is caused to be 1.0 (FAF1=1.0), thereby carrying out an open-loop control operation.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1≦0, the control proceeds directly to step 306. At step 306, the first delay counter CDLY1 is counted down by 1, and at step 307, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0, the control proceeds to step 311, which clears the first delay counter CDLY1, and then proceeds to step 312. If CDLY1≧0, the control directly proceeds to 312. At step 312, the first delay counter CDLY1 is counted up by 1, and at step 313, it is determined whether or not CDLY1 <TDR1. Note that TDR1 is a rich delay time period for which a lean state is maintained even after the output of the upstream-side $O_2$ sensor 13 is changed from the lean side to the rich side, and is defined by a positive value. Therefore, at step 313, only when CDLY1<TDR1 does the control proceed to step 314, which causes CDLY1 to be TDR1, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 321, which carry out a learning control operation and a skip operation.

That is, at step 317, it is determined whether or not all the learning control conditions are satisfied. The learning control conditions are as follows:

(i) the coolant temperature THW is higher than 70° C. and lower than 90° C.; and (ii) the deviation ΔQ of the intake air amount is smaller than a predetermined value.

Of course, other leaning control conditions are also introduced as occasion demands. If one or more of the learning control conditions are not satisfied, the control proceeds to step 319, and if all the learning control conditions are satisfied, the control proceeds to step 318 which carries out a learning control operation, which will be explained later with reference to FIG. 4.

At step 319, if the flag F1 is "0" (lean) the control proceeds to step 320, which remarkably increases the correction amount FAF by a skip amount RSR. Also, if the flag F1 is "1" (rich) at step 319, the control proceeds to step 321, which remarkably decreases the correction amount FAF1 by the skip amount RSL.

On the other hand, if the first air-fuel ratio flag F1 is not reversed at step 316, the control proceeds to step 322 to 324, which carries out an integration operation. That is, if the flag F1 is "0" (lean) at step 322, the control proceeds to step 323, which gradually increases the correction amount FAF1 by a rich integration amount KIR. Also, if the flag F1 is "1" (rich) at step 322, the control proceeds to step 324, which gradually decreases the correction amount FAF1 by a lean integration amount KIL.

The correction amount FAF1 is guarded by a minimum value 0.8 at steps 325 and 326, and by a maximum value 1.2 at steps 327 and 328, thereby also preventing the controlled air-fuel ratio from becoming overrich or overlean.

The correction amount FAF1 is then stored in the RAM 105, thus completing this routine of FIG. 3 at step 330.

The learning control at step 318 of FIG. 3 is explained with reference to FIG. 4.

At step 401, a mean value FAFAV of the air-fuel ratio correction coefficient FAF1 is calculated by $$FAFAV \leftarrow (FAFA1 + FAFA1_0)/2$$

where $FAF1_0$ is a value of the air-fuel ratio correction coefficient FAF1 fetched previously at a skip operation. That is, the mean value FAFAV is a mean value of two successive values of the air-fuel ratio correction coefficient FAF1 immediately before the skip operations. Note that the mean value FAFAV can be obtained by four or more successive maximum and minimum values of the air-fuel ratio correction coefficient FAF1. At step 402, in order to prepare the next execution, $$FAF1_0 \leftarrow FAF1.$$

At step 403, a difference between the mean value FAFAV and a reference value, which, in this case, is a definite value such as 1.0 corresponding to the stoichiometric air-fuel ratio, is calculated by:

$$\Delta FAF \leftarrow FAFAV - 1.0$$

Note that the definite value 1.0 is the same as the value of the air-fuel ratio correction coefficient FAF1 in an open-loop control by the upstream side $O_2$ sensor 13 (see step 329 of FIG. 3).

At step 404, it is determined whether the difference ΔFAF is within a predetermined range ($-0.05 < \Delta FAF < 0.05$). As a result, if $\Delta FAF \leqq -0.05$, then the base air-fuel ratio before the execution of the next skip operation is too lean. Then, at step 405, a learning correction amount FGHAC is decreased by $$FGHAC \leftarrow FGHAC - \Delta FGHAC$$

where ΔFGHAC is a definite value. Contrary to this, if $\Delta FAF \geqq 0.05$, then the base air-fuel ratio before the execution of the next skip operation is too rich. Then, at step 406, the learning correction amount FGHAC is increased by $$FGHAC \leftarrow FGHAC + \Delta FGHAC$$

Further, if $-0.05 < \Delta FAF < 0.05$, the control proceeds directly to step 407, so that the learning correction amount FGHAC is not changed. Note that the range of ΔFAF defined at step 404 can be changed as occasion demands.

Figures 5A, 5B, 5C, 5D:
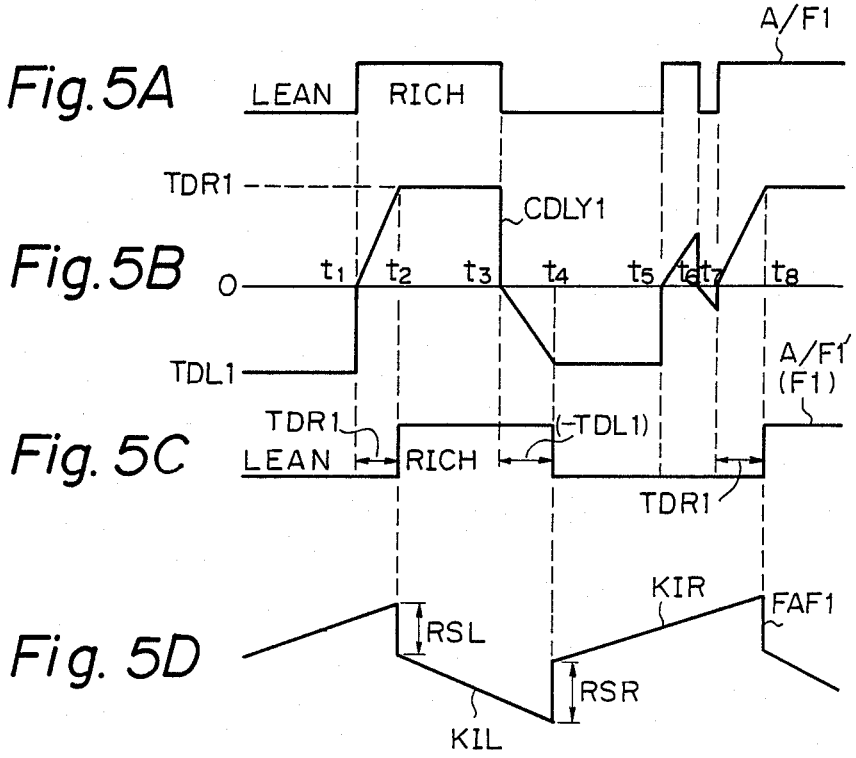
FIGS. 5A through 5D are timing diagrams explaining the flow chart of FIG. 4.

The operation by the flow chart of FIG. 3 will be further explained with reference to FIGS. 5A through 5D. As illustrated in FIG. 5A, when the air-fuel ratio A/F1 is obtained by the output of the upstream-side $O_2$ sensor 13, the first delay counter CDLLY1 is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio A/F1′ (F1) is changed at time $t_2$ after the rich delay time period TDR1. Similarly, at time $t_3$, even when the air-fuel ratio A/F1 is changed from the rich side to the lean side, the delayed air-fuel ratio F1 is changed at time $t_4$ after the elan delay time period TDL1. However, at time $t_5$, $t_6$, or $t_7$, when the air-fuel ratio A/F1 is reversed within a smaller time period than the rich delay time period TDR1 or the lean delay time period TDL1, the delay air-fuel ratio A/F1′ is reversed at time $t_8$. That is, the delayed air-fuel ratio A/F1′ is stable when compared with the air-fuel ratio A/F1. Further, as illustrated in FIG. 5D, at every change of the delayed air-fuel ratio A/F1′ from the rich side to the lean side, or vice versa, the correction amount FAF1 is skipped by the skip amount RSR or RSL, and also, the correction amount FAF1 is gradually increased or decreased in accordance with the delayed air-fuel ratio A/F1′.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes larger than the lean delay time period (TDR1>(−TDL1)), the controlled air-fuel ratio becomes richer, and if the lean delay time period becomes larger than the rich delay time period ((−TDL1)>TDR1), the controlled air-fuel ratio becomes leaner. Thus, the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the downstream-side $O_2$ sensor 15. Further, if the rich integration amount KRI is increased or if the lean integrating amount KIL is decreased, the controlled air-fuel ratio becomes richer, and if the lean integration amount KIL is increased or if the rich integration amount KIR is decreased, the controlled air-fuel ratio becomes léaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 6 and 7.

Figures 6, 6A:
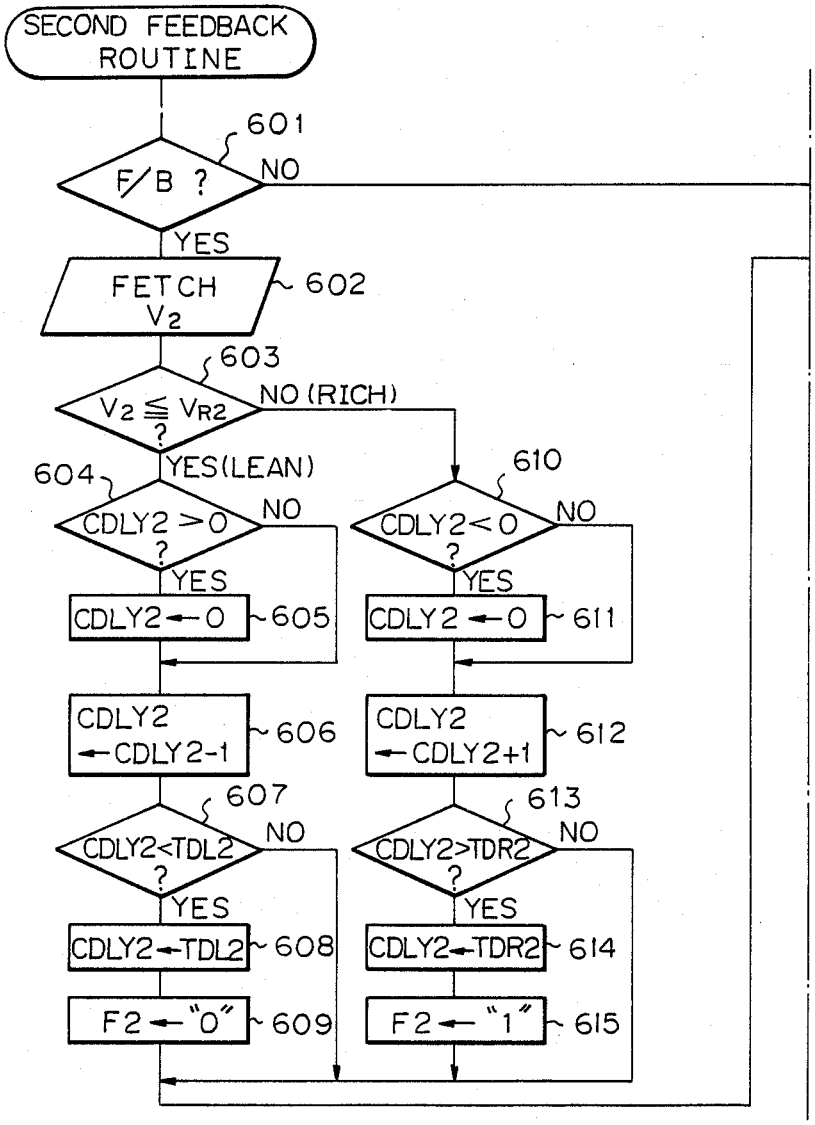
Figure 6B:
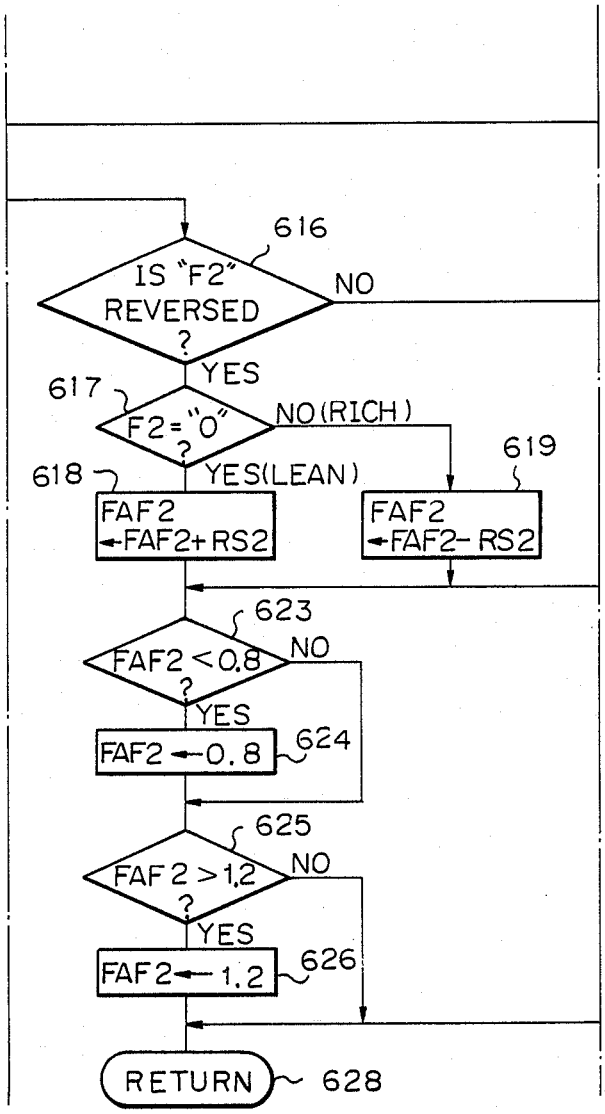
Figure 6C:
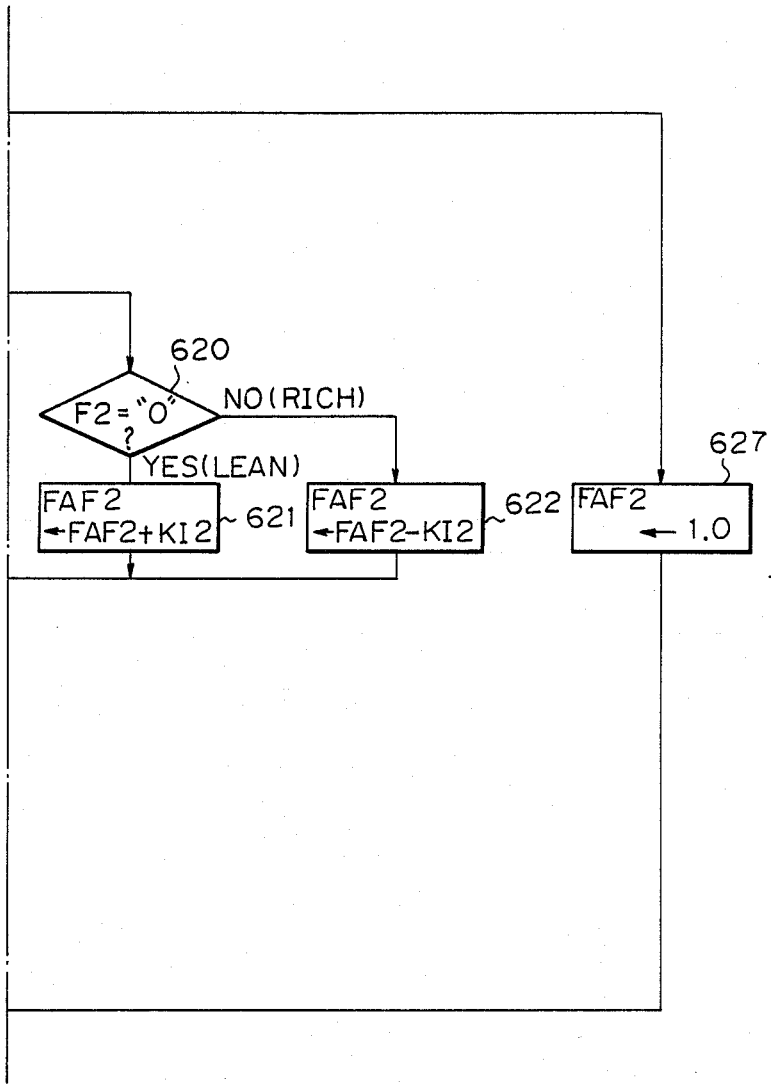

FIG. 6 is a routine for calculating a second air-fuel ratio feedback correction amount FAF2 in accordance with the output of the downstream-side $O_2$ sensor 15 executed at every predetermined time period such as 1 s.

At step 601, it is determined all the feedback control (closed-loop control) conditions by the downstream-side $O_2$ sensor 15 are satisfied. The feedback control conditions are as follows:

(i) the engine is not in a starting state;
(ii) the coolant temperature THW is higher than 50° C.; and
(iii) the power fuel incremental amount FPOWER is 0.

Of course, other feedback control conditions are introduced as occasion demands. However, an explanation of such other feedback control conditions is omitted.

If one more of the feedback control conditions is not satisfied, the control also proceeds to step 627, thereby carrying out an open-loop control operation.

Contrary to the above, at step 601, if all of the feedback control conditions are satisfied, the control proceeds to step 602.

At step 602, an A/D conversion is performed upon the output voltage $V_2$ of the downstream-side $O_2$ sensor 15, and the A/D converted value thereof is then fetched from the A/D converter 101. Then, at step 603, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 604 through 615 correspond to step 304 through 315, respectively, of FIG. 3, thereby performing a delay operation upon the determination at step 603. Here, a rich delay time period is defined by TDR2, and a lean delay time period is defined by TDL2. As a result of the delayed determination, if the air-fuel ratio is rich a second air-fuel ratio flag F2 is caused to be "1", and if the air-fuel ratio is lean, a second air-fuel ratio flag F2 is caused to be "0".

Next, at step 616, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 617 to 619 which carry out a skip operation. That is, if the flag F2 is "0" (lean) at step 617, the control proceeds to step 618, which remarkably increases the second correction amount FAF2 by skip amount RS2. Also, if the flag F2 is "1" (rich) at step 617, the control proceeds to step 619, which remarkably decreases the second correction amount FAF2 by the skip amount RS2. On the other hand, if the second air-fuel ratio flag F2 is not reversed at step 616, the control proceeds to steps 620 to 622, which carries out an integration operation. That is, if the flag F2 is "0" (lean) at step 620, the control proceeds to step 621, which gradually increases the second correction amount FAF2 by an integration amount KI2. Also, if the flag F2 is "1" (rich) at step 620, the control proceeds to step 622, which gradually decreases the second correction amount FAF2 by the integration amount KI2.

Note that the skip amount RS2 is larger than the integration amount KI1.

The second correction amount FAF2 is guarded by a minimum value 0.8 at steps 623 and 624, and by a maximum value 1.2 at steps 625 and 626, thereby also preventing the controlled air-fuel ratio from becoming overrich or overlean.

The correction amount FAF2 is then stored in the RAM 105, thus completing this routine of FIG. 6 at step 628.

Figure 7:
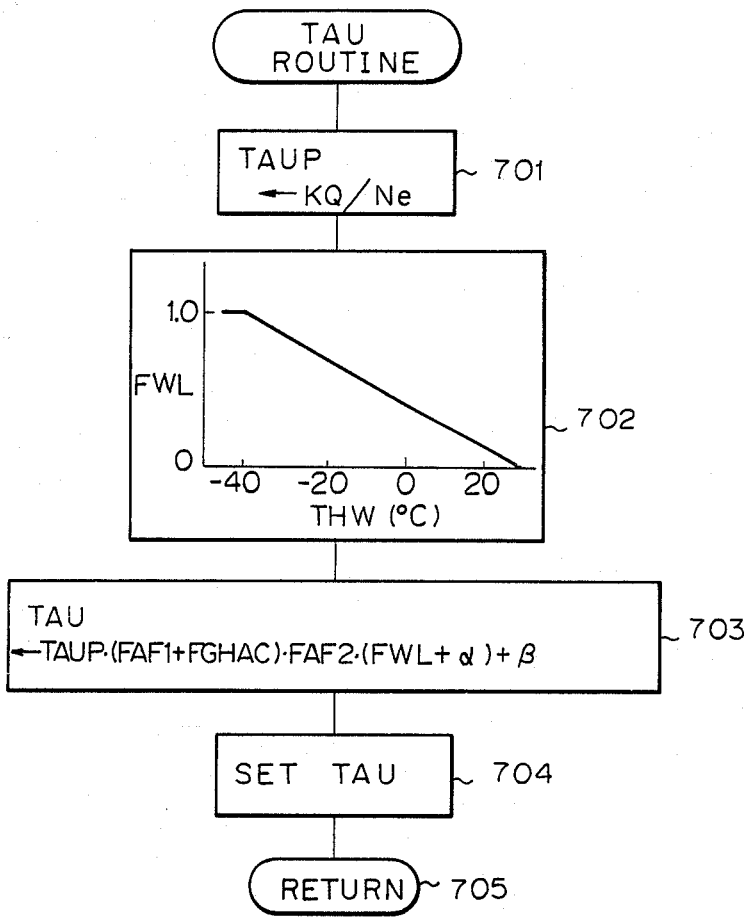

FIG. 7 is a routine for calculating a fuel injection amount TAU executed at every predetermined crank angle such as 360° CA. At step 701, a base fuel injection amount TAUP is calculated by using the intake air amount data Q and the engine speed data Ne stored in the RAM 105. That is, $$TAUP \leftarrow KQ/Ne$$

where K is a constant. Then at step 702, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 703, a final fuel injection amount TAU is calculated by $$TAU \leftarrow TAUP \cdot (FAF1 + FGHAC) \cdot FAF2 \cdot (FWL + \alpha) + \beta$$

Where $\alpha$ and $\beta$ are correction factors determined by other parameters such as the voltage of the battery and the temperature of the intake air. At step 704, the final fuel injection amount TAU is set in the down counter 107, and in addition, the flip-flop 108 is set initiate the activation of the fuel injection valve 7. Then, this routine is completed by step 705. Note that, as explained above, when a time period corresponding to the amount TAU passes, the flip-flop 109 is reset by the carry-out signal of the down counter 108 to stop the activation of the fuel injection valve 7.

Figures 8A, 8B, 8C, 8D, 8E, 8F, 8G, 8H:
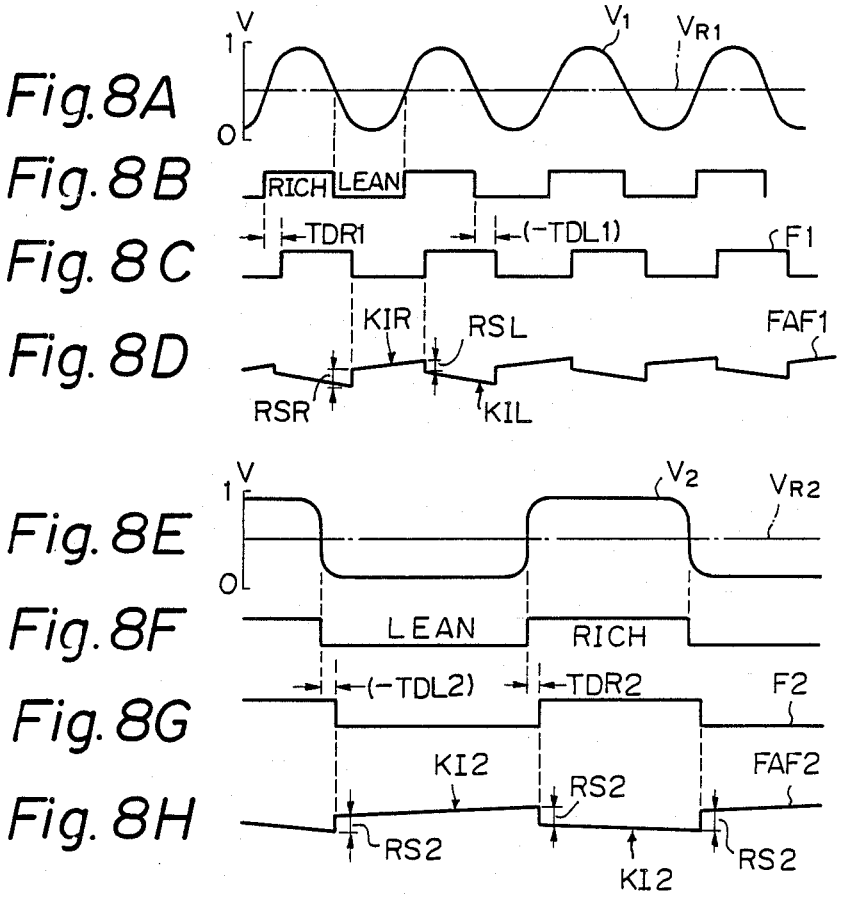
FIGS. 8A through 8H are timing diagrams explaining the flow charts of FIGS. 3, 4, 6, and 7.

FIGS. 8A through 8H are timing diagrams for explaining the two air-fuel ratio correction amounts FAF1 and FAF2 obtained by the flow charts of FIGS. 3, 4, 6, and 7. In this case, the engine is in a closed-loop control state for the two $O_2$ sensors 13 and 15. When the output of the upstream-side $O_2$ sensor 13 is changed as illustrated in FIG. 8A, the determination at step 303 of FIG. 3 is shown in FIG. 8B, and a delayed determination thereof corresponding to the first air-fuel ratio flag F1 is shown in FIG. 8C. As a result, as shown in FIG. 8D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 8E, the determination at step 603 of FIG. 6 is shown in FIG. 8F, and the delayed determination thereof corresponding to the second air-fuel ratio flag F2 is shown in FIG. 8G. As a result, as shown in FIG. 8H, every time the delayed determination is changed from the rich side to the lean side, or vice versa, the second air-fuel ratio correction amount FAF2 is skipped by the skip amount RS2.

A double $O_2$ sensor system, in which an air-fuel ratio feedback control parameter of the first air-fuel ratio feedback control by the upstream-side $O_2$ sensor is variable, will be explained with reference to FIGS. 9 and 10. In this case, the skip amounts RSR and RSL as the air-fuel ratio feedback control parameters are variable.

Figures 9, 9A:
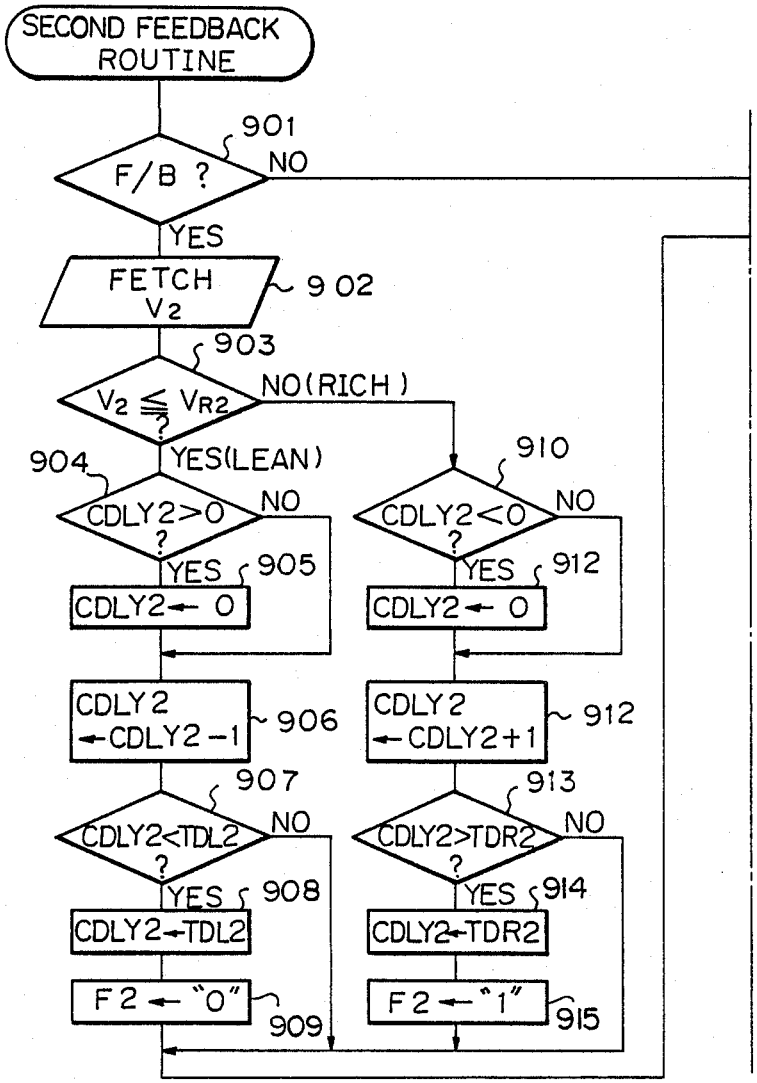
Figure 9B:
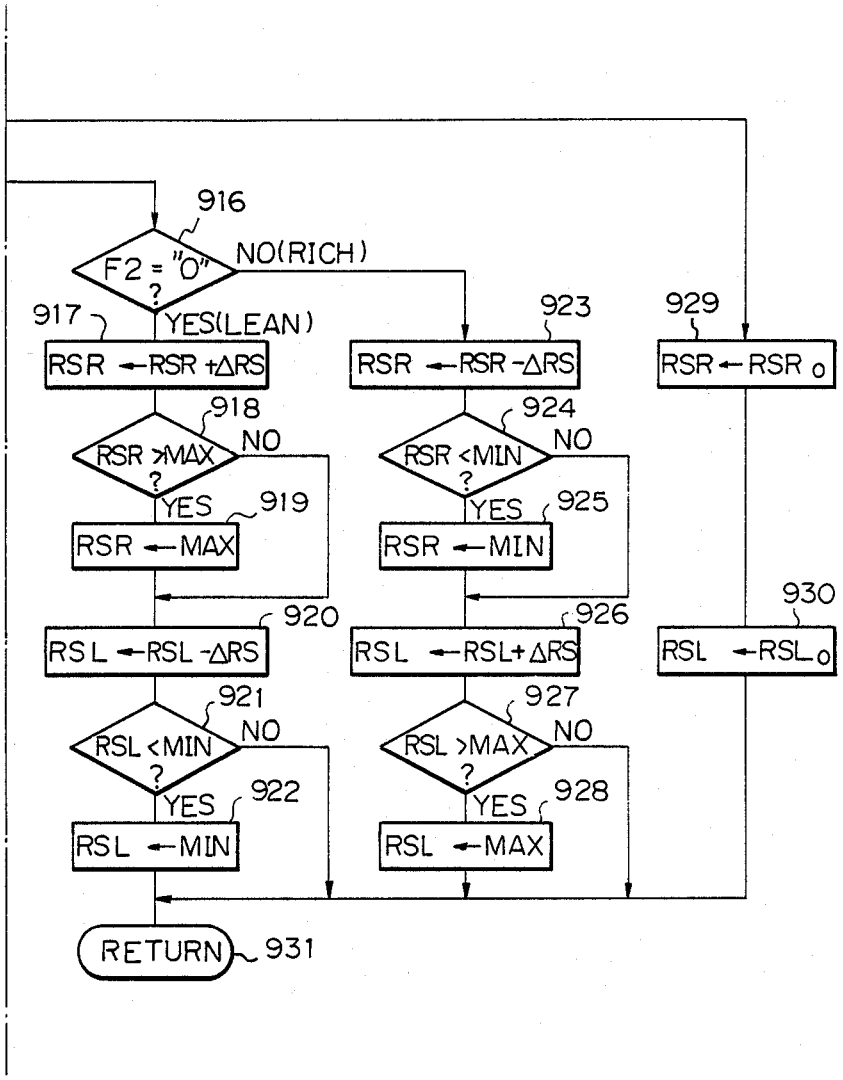

FIG. 9 is a routine for calculating the skip amounts RSR and RSL in accordance with the output of the downstream-side $O_2$ sensor 15 executed at every predetermined tim period such as 1 s.

Steps 901 through 915 are the same as steps 601 through 615 of FIG. 6. That is, if one or more of the feedback control conditions is not satisfied, the control proceeds to steps 929 and 930, thereby carrying out an open-loop control operation. For example, the rich skip amount RSR and the lean skip amount RSL are made definite values $RSR_0$ and $RSL_0$ which are, for example, 5%.

Contrary to the above, if all of the feedback control conditions are satisfied, the second air-fuel ratio flag F2 is determined by the routine of steps 902 through 915.

At step 916, it is determined whether or not the second air-fuel ratio F2 is "0". If F2="0", which means that the air-fuel ratio is lean, the control proceeds to steps 917 through 922, and if F2="1", which means that the air-fuel ratio is rich, the control proceeds to steps 923 through 928.

At step 917, the rich skip amount RSR is increased by a definite value ΔRS which is, for example, 0.08, to move the air-fuel ratio to the rich side. At steps 918 and 919, the rich skip amount RSR is guarded by a maximum value MAX which is, for example, 6.2%. Further, at step 920, the lean skip amount RSL is decreased by the definite value ΔRS to move the air-fuel ratio to the lean side. At steps 921 and 922, the lean skip amount RSL is guarded by a minimum value MIN which is, for example 2.5%.

On the other hand, at step 923, the rich skip amount RSR is decreased by the definite value ΔRS to move the air-fuel ratio to the lean side. At steps 924 and 925, the rich skip amount RSR is guarded by the minimum value MIN. Further, at step 926, the lean skip amount RSL is decreased by the definite value ΔRS to move the air-fuel ratio to the rich side. At steps 927 and 928, the lean skip amount RSL is guarded by the maximum value MAX.

The skip amounts RSR and RSL are then stored in the RAM 105, thereby completing this routine of FIG. 9 at step 931.

Thus, according to the routine of FIG. 9, when the delayed output of the second $O_2$ sensor 15 is lean, the rich skip amount RSR is gradually increased, and the lean skip amount RSL is gradually decreased, thereby moving the air-fuel ratio to the rich side. Contrary to this, when the delayed output of the second $O_2$ sensor 15 is rich, the rich skip amount RSR is gradually decreased, and the lean skip amount RSL is gradually increased, thereby moving the air-fuel ratio to the lean side.

Figure 10:
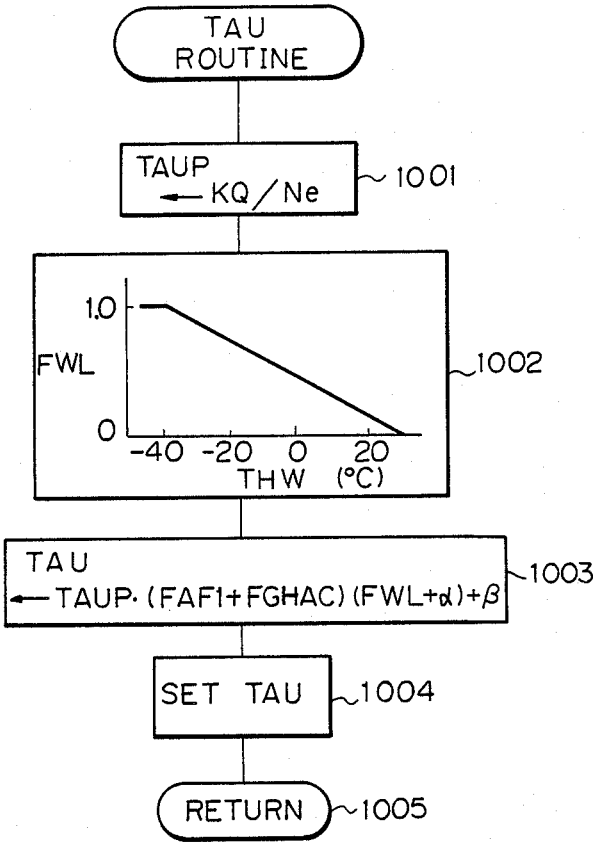

FIG. 10 is a routine for calculating a fuel injection amount TAU executed at every predetermined crank angle such as 360° CA. At step 1001, a base fuel injection amount TAUP is calculated by using the intake air amount data Q and the engine speed data Ne stored in the RAM 105. That is, $$TAUP \leftarrow KQ/Ne$$

where K is a constant. Then at step 1002, a warming-up incremental amount FWL is calculated from a one-dimensional map by using the coolant temperature data THW stored in the RAM 105. Note that the warming-up incremental amount FWL decreases when the coolant temperature THW increases. At step 1003, a final fuel injection amount TAU is calculated by $$TAU \leftarrow TAUP \cdot (FAF1 + FGHAC) \cdot (FWL + \alpha) + \beta$$

where α and β are correction factors determined by other parameters such as the voltage of the battery and the temperature of the intake air. At step 1004, the final fuel injection amount TAU is set in the down counter 108, and in addition, the flip-flop 109 is set to initiate the activation of the fuel injection valve 7. Then, this routine is completed by step 1005. Note that, as explained above, when a time period corresponding to the amount TAU has passed, the flip-flop 109 is reset by the carry-out signal of the down counter 108 to stop the activation of the fuel injection valve 7.

Figures 11A, 11B, 11C, 11D, 11E, 11F, 11G, 11H, 11I:
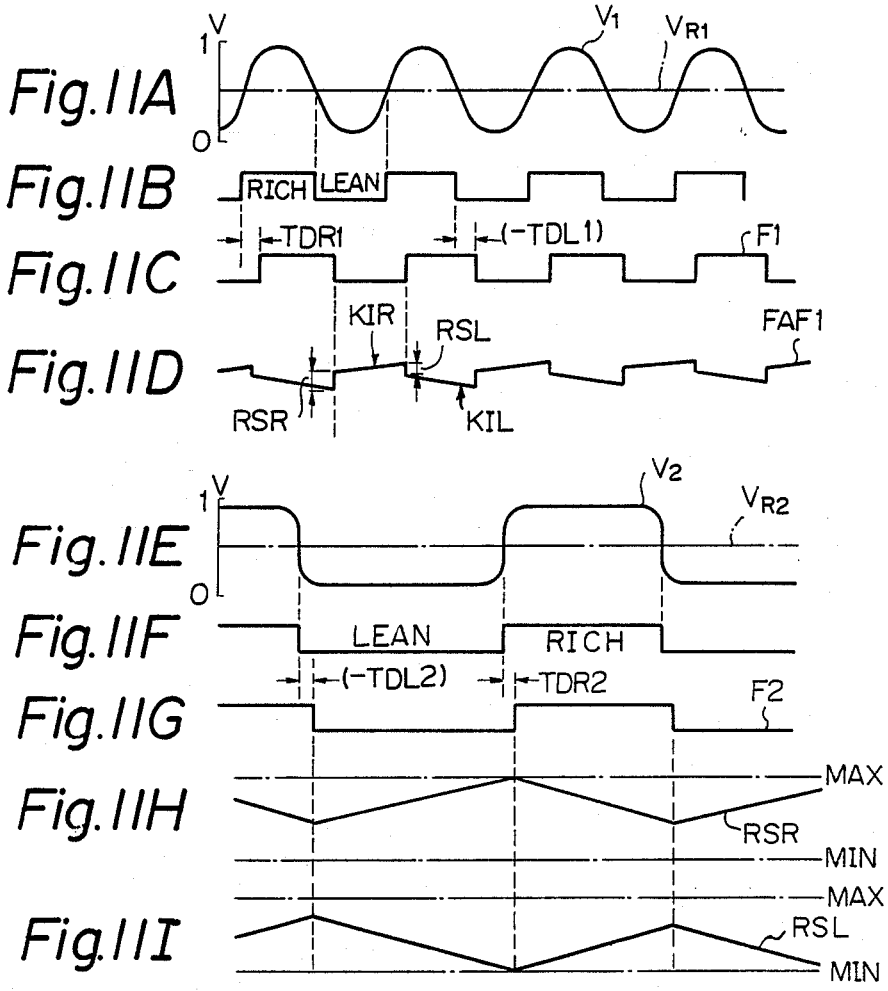
FIGS. 11A through 11I are timing diagrams explaining the flow charts of FIGS. 3, 4, 9, and 10.

FIGS. 11A through 11I are timing diagrams for explaining the air-fuel ratio correction amount FAF1 and the skip amounts RSR and RSL obtained by the flow charts of FIGS. 3, 4, 9, and 10. FIGS. 11A through 11G are the same as FIGS. 8A through 8G, respectively. As shown in FIGS. 11H and 11I, when the delayed determination F2 is lean, the rich skip amount RSR is increased and the lean skip amount RSL is decreased, and when the delayed determination F2 is rich, the rich skip amount RSR is decreased and the lean skip amount RSL is increased. In this case, the skip amounts RSR and RSL are changed within a range from MAX to MIN.

Note that the calculated parameters FAF1 and FAF2, or FAF1, RSR, and RSL can be stored in the backup RAM 106, thereby improving drivability at the re-starting of the engine.

Thus, since a learning control operation is introduced into the double $O_2$ sensor system, the deviation of the air-fuel ratio correction coefficient FAF1 from the reference level is absorbed by the learning correction amount FGHAC, so that the air-fuel ratio correction coefficient FAF1 is changed in the vicinity of the reference level during a closed-loop control by the upstream-side $O_2$ sensor 13. That is, the fuel injection amount TAU during a closed-loop control by the upstream-side $O_2$ sensor 13 is dependent upon:

$$FAF1 + FGHAC \quad (1)$$

where the mean value of FAF1 is 1.0. On the other hand, the fuel injection amount TAU during an open-loop control is dependent upon:

$$1.0 + FGHAC \quad (2)$$

Thus, there is no substantial difference in TAU between a closed-loop control and an open-loop control, and accordingly, the controlled air-fuel ratio during an open-loop control is substantially the same as the optimum level, i.e., the stoichiometric air-fuel ratio.

Figure 4:
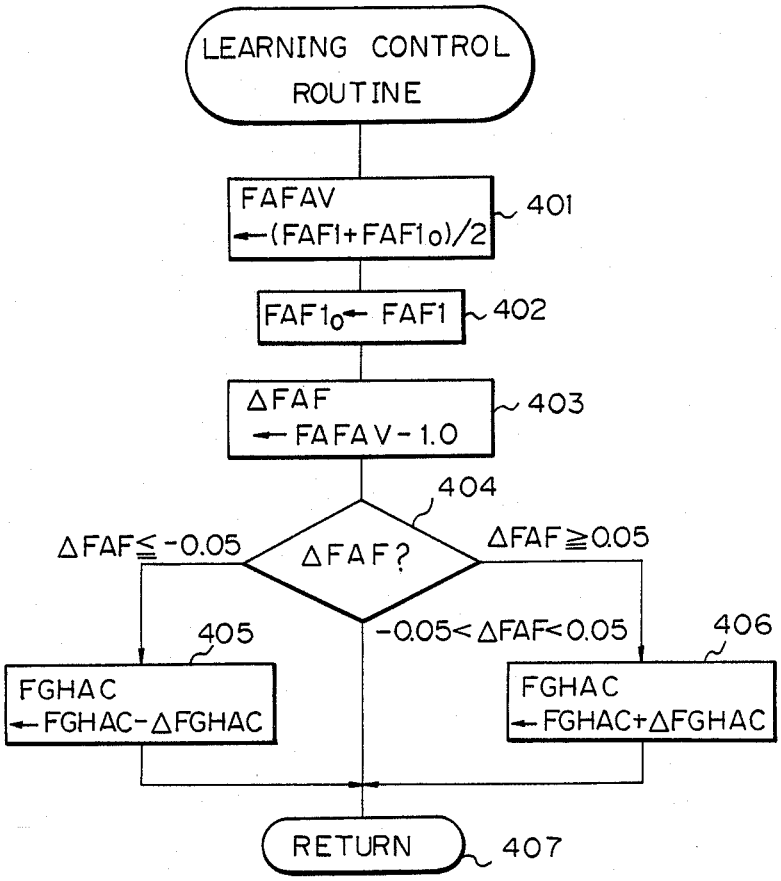

At step 403 of FIG. 4, however, the value ΔFAF is not an accurate deviation of the air-fuel ratio correction coefficient FAF1 from the reference level (1.0), since the mean value FAFAV obtained by two successive maximum and minimum values of the air-fuel ratio correction coefficient FAF1 is not an accurate mean value thereof. This is because the air-fuel ratio feedback control parameters such as RSR and RSL during a closed-loop control are different from each other, and accordingly, the air-fuel ratio correction coefficient FAF1 is changed asymmetrically. As a result, a learning control operation is erroneously carried out to compensate for such a small error in ΔFAF, so that the learning correction amount FGHAC is deviated a little from an optimum level, thereby deviating the controlled air-fuel ratio during an open-loop control from the stoichiometric air-fuel ratio.

Figure 12:
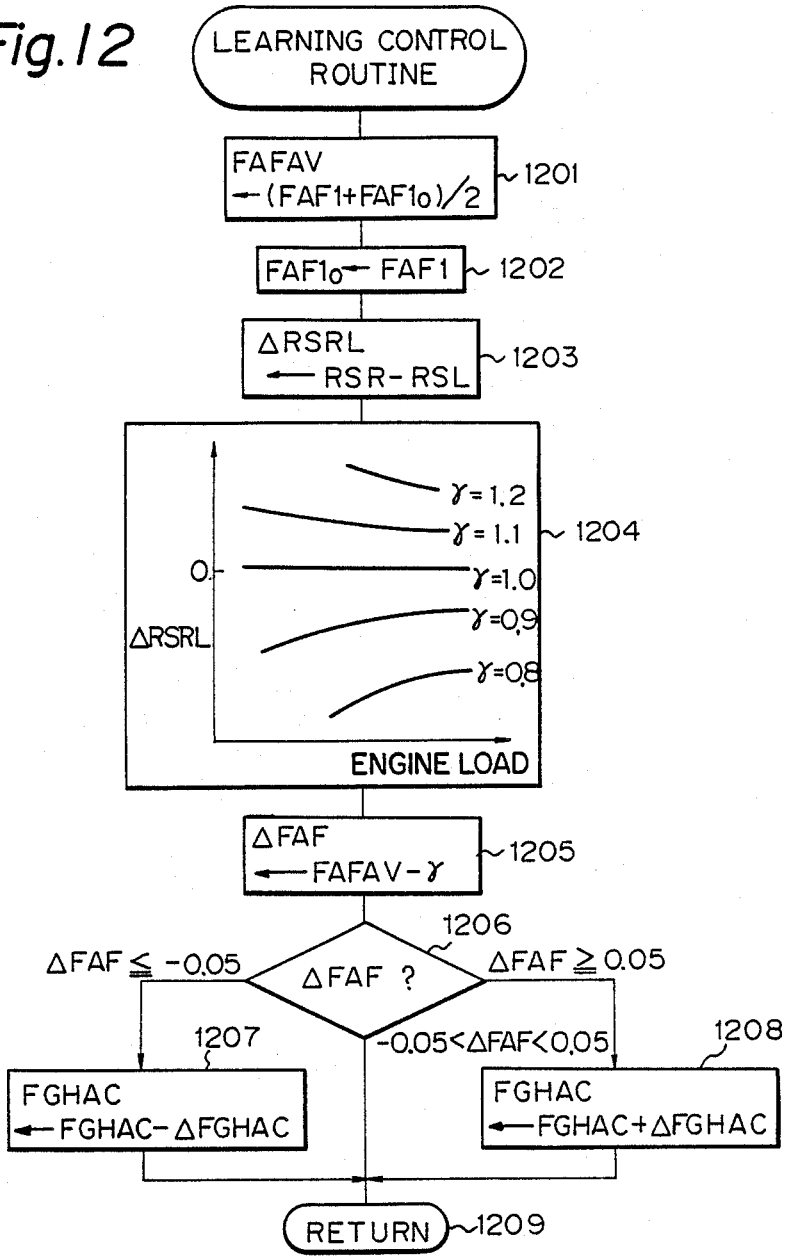

To compensate for the above-mentioned deviation of the controlled air-fuel ratio during an open-loop control, the routine of FIG. 12 is used instead of the routine of FIG. 4. That is, in FIG. 12, the reference value designated by reference $\gamma$ is variable in accordance with the degree of asymmetry of the air-fuel ratio correction coefficient FAF1, which can be indicated by the air-fuel ratio feedback control parameters such as RSR and RSL, and KIR and KIL. Note that, in this case, at step 329 of FIG. 3, the air-fuel ratio correction coefficient FAF1 is caused to be $\gamma$.

In FIG. 12, steps 1201, 1202, 1205 to 1209 are the same as steps 401 to 407 of FIG. 4, respectively, and step 1205 corresponds to step 404 of FIG. 4. That is, steps 1203 and 1204 are added to the routine of FIG. 4.

At step 1203, a difference ΔRSRL between the rich skip amount RSR and the lean skip amount RSL is calculated by:

$$\Delta RSRL \leftarrow RSR - RSL.$$

Assuming that the rich integration amount KIR equals the lean integration amount KIL, then the difference ΔRSRL indicates the degree of asymmetry of the air-fuel ratio correction coefficient FAF1.

At step 1204, the reference value $\gamma$ is calculated from a two-dimensional map stored in the ROM 104 by using the difference ΔRSRL and an engine load parameter such as the intake air amount Q, the intake air amount Q/Ne per one revolution, the intake air pressure PM, or the throttle opening TA.

Figure 13A:
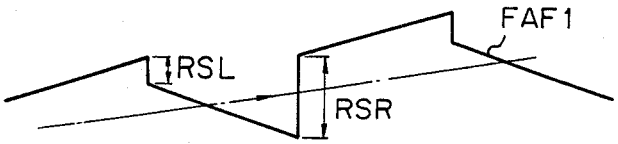
FIGS. 13A through 13D are timing diagrams explaining step 1204 of FIG. 12.
Figure 13B:
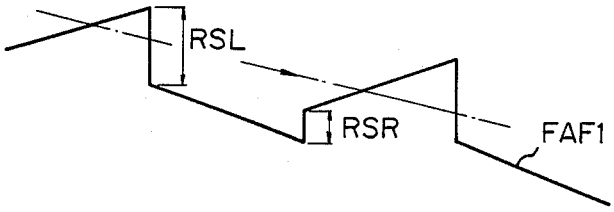
Figure 13C:
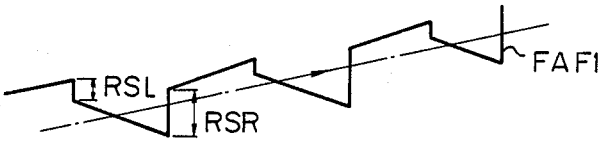
Figure 13D:
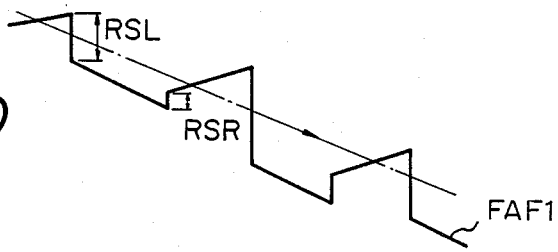

That is, the reference value $\gamma$ is calculated in accordance with the deviation of the air-fuel ratio correction coefficient FAF1 from a definite value (=1.0). For example, if $\Delta RSRL > 0$, i.e., if $RSR > RSL$ the air-fuel ratio correction coefficient FAF1 tends to increase as illustrated in FIG. 13A, and the reference value $\gamma$ is caused to be larger than 1.0. Contrary to this, if $\Delta RSRL < 0$, i.e., if, $RSR < RSL$, the air-fuel ratio correction coefficient FAF1 tends to decrease as illustrated in FIG. 13B, and the reference value $\gamma$ is caused to be smaller than 1.0. Further, when the engine load such as the intake air amount Q is increased, the frequency of the feedback of the air-fuel ratio is increased as illustrated in FIGS. 13C and 13D, and accordingly, the air-fuel ratio correction coefficient FAF1 is further increased or decreased. Therefore, when the engine load is increased, the reference value $\gamma$ is decreased. That is, the reference value $\gamma$ corresponds to the optimum level, i.e., the stoichiometric air-fuel ratio.

At step 1205, a difference between the mean value FAFAV of the air-fuel ratio correction coefficient FAF1 and the reference value $\gamma$ is calculated by:

$$\Delta FAF \leftarrow FAFAV - \gamma.$$

Figures 14B, 14C, 14D, 14E:
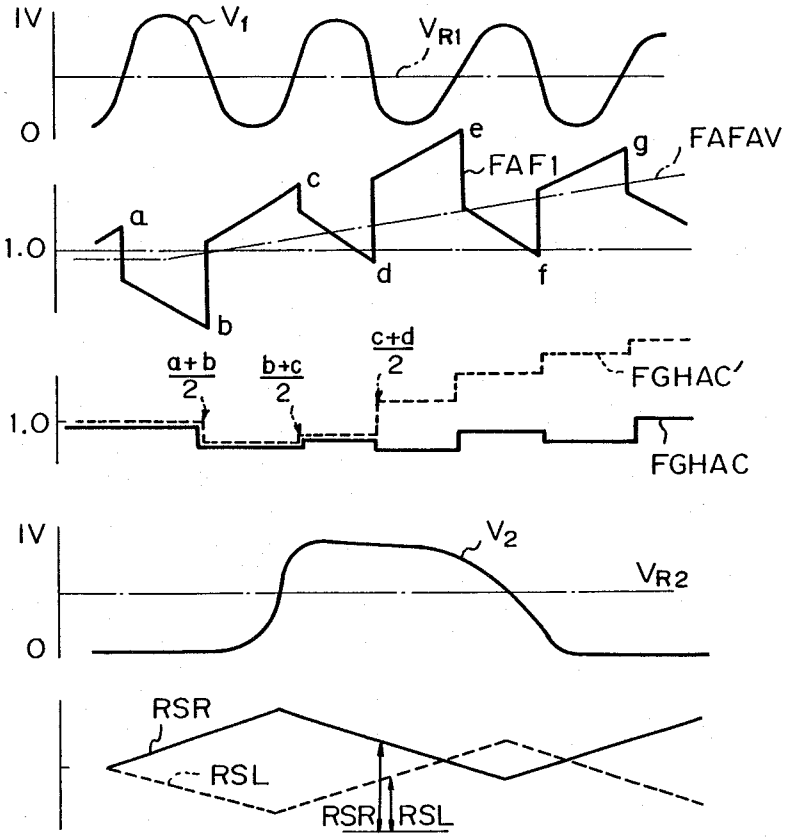

According to the routine of FIG. 12, even when the output $V_1$ of the upstream-side $O_2$ sensor 13 is changed as illustrated in FIG. 14A, and the air-fuel ratio correction coefficient FAF1 corresponding to the base air-fuel ratio is changed as illustrated in FIG. 14B, the learning correction amount FGHAC is almost unchanged as illustrated in FIG. 14C. In this case, when the output $V_2$ of the downstream-side $O_2$ sensor 15 is changed as illustrated in FIG. 14D, and as a result, the rich skip amount RSR and the lean skip amount RSL are changed as illustrated in FIG. 14E, the reference value $\gamma$ is changed in accordance with the mean value FAFAV as illustrated in FIG. 14B, which is anticipated by the difference between RSR and RS and the engine load. Note that, the reference value $\gamma$ is a definite value such as 1.0, the learning correction amount indicated by reference FGHAC' in FIG. 14B is changed in accordance with the mean value FAFAV as illustrated in FIG. 14B, thereby deviating the controlled air-fuel ratio during an open-loop control.

Figure 15:
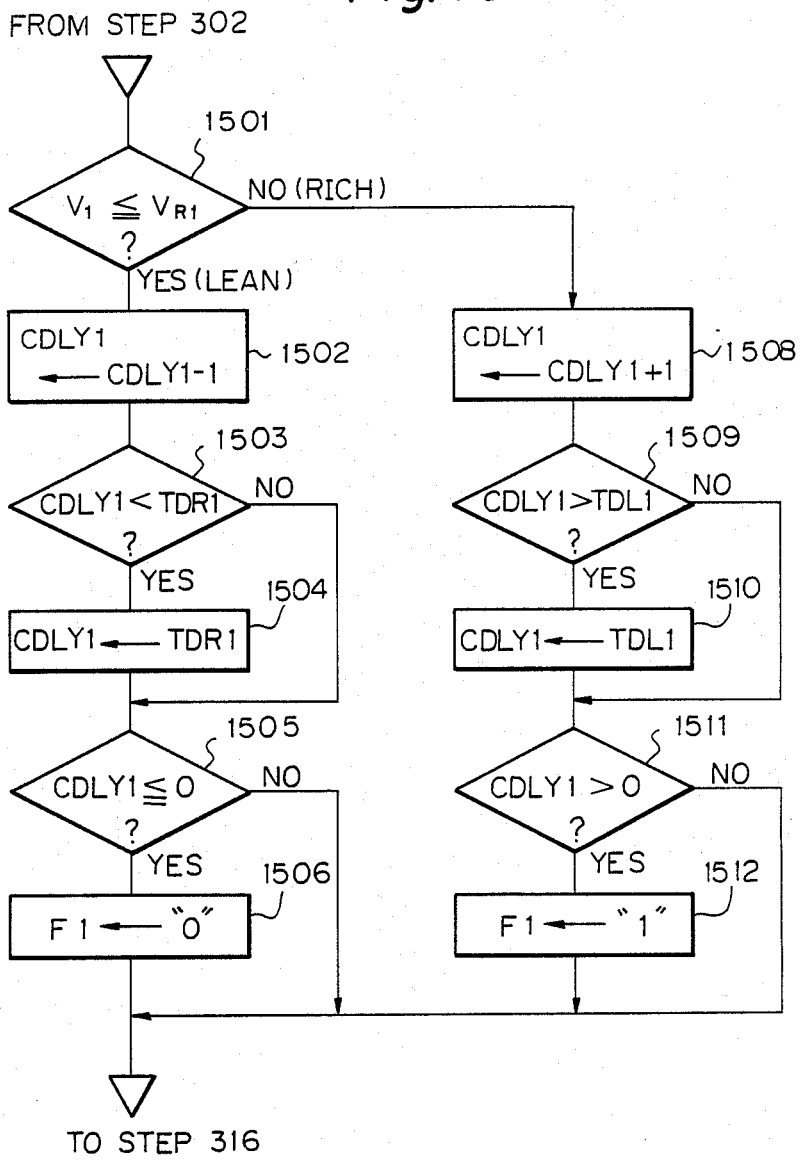

In FIG. 15, which is a modification of FIG. 3, a delay operation different from the of FIG. 3 is carried out. That is, at step 1501, if $V_1 \leqq V_{R1}$, which means that the current air-fuel ratio is lean, the control proceeds to steps 1502 which decreases a first delay counter CDLY1 by 1. Then, at steps 1503 and 1504, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if $CDLY1 > 0$, then the delayed air-fuel ratio is rich, and if $CDLY \leqq 0$, then the delayed air-fuel ratio is lean.

Therefore, at step 1505, it is determined whether or not $CDLY \leqq 0$ is satisfied. As a result, if $CDLY1 < 0$, at step 1506, the first air-fuel ratio flag F1 is caused to be "0" (lean). Otherwise, the first air-fuel ratio flag F1 is unchanged, that is, the flag F1 remains at "1".

On the other hand, if $V_1 < V_{R1}$, which means that the current air-fuel ratio is rich, the control proceeds to step 1508 which increases the first delay counter CDLY1 by 1. Then, at steps 1509 and 1510, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1511, it is determined whether or not $CDLY1 > 0$ is satisfied. As a result, if $CDLY1 > 0$, at step 1512, the first air-fuel ratio flag F1 is caused to be "1" (rich). Otherwise, the first air-fuel ratio flag F1 is unchanged, that is, the flag F1 remains at "0".

Figures 16A, 16B, 16C, 16D:
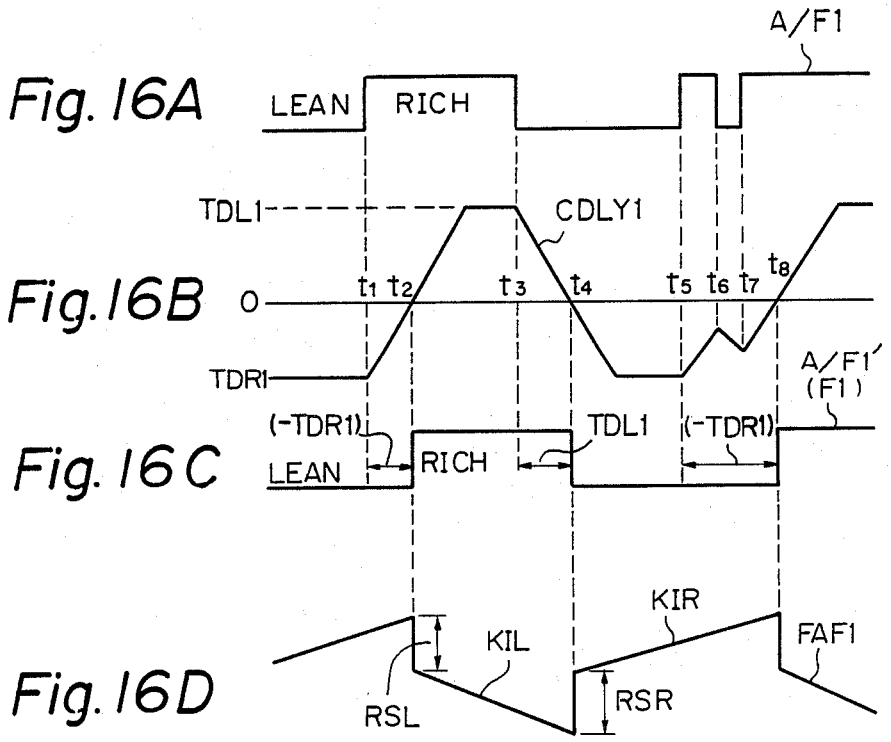
FIGS. 16A through 16D are timing diagrams explaining the flow chart of FIG. 15.

The operation by the flow chart of FIG. 15 will be further explained with reference to FIGS. 16A through 16D. As illustrated in FIGS. 16A, when the air-fuel ratio A/F1 is obtained by the output of the upstream-side $O_2$ sensor 13, the first delay counter CDLY1 is counted up during a rich state, and is counted down during a lean state, as illustrated in FIG. 16B. As a result, the delayed air-fuel ratio A/F1' is obtained as illustrated in FIG. 16C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller tim period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 16D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

Figure 17:
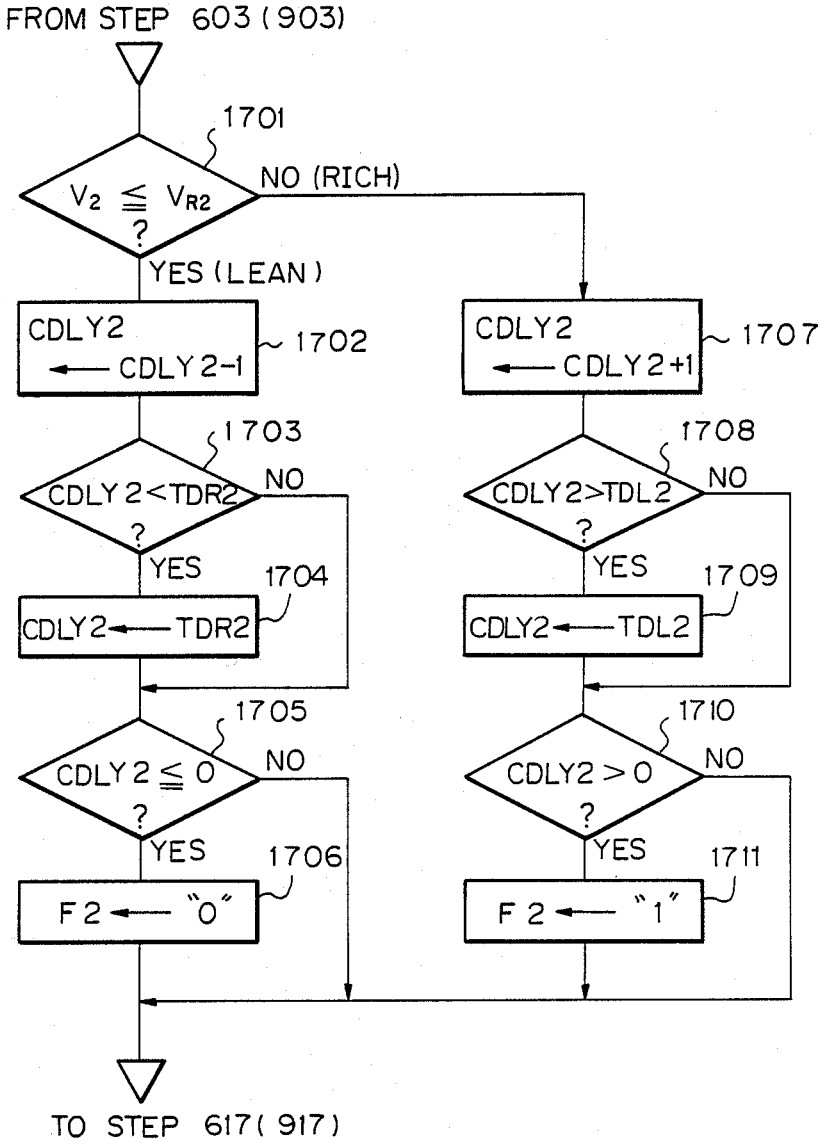

In FIG. 17, which is a modification of FIG. 6 or 9, the same delay operation as in FIG. 15 is carried out, and therefore, a detailed explanation thereof is omitted.

Also, the first air-fuel ratio feedback control by the upstream-side $O_2$ sensor 13 is carried out at every relatively small time period, such as 4 ms, and the second air-fuel ratio feedback control by the downstreamside $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as, the integration amounts KIR and KIL, the delay time periods TDR1 and TDL1 or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 701 of FIG. 7 or at step 1001 of FIG. 10 is determined by the carburetor itself, i.e., the intake air negative pressure and the engine speed, and the air amount corresponding to TAU at step 703 of FIG. 7 or at step 1003 of FIG. 10.

Further, a CO sensor, a lean-mixture sensor or the like can be also used instead of the $O_2$ sensor.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

determining whether or not the mean value of said air-fuel ratio correction amount is larger than a variable reference value determined in accordance with an air-fuel ratio feedback control parameter, said reference value corresponding to a stoichiometric air-fuel ratio;

increasing a learning correction amount when the mean value of said air-fuel ratio correction amount is larger than said reference value;

decreasing said learning correction amount when the mean value of said air-fuel ratio correction amount is not larger than said reference value; and adjusting an actual air-fuel ratio in accordance with said air-fuel ratio correction amount and said learning correction amount.

2. A method as set forth in claim 1, further comprising a step of changing said reference value in accordance with a load of said engine.

3. A method as set forth in claim 2, wherein the load of said engine is an intake air amount of said engine.

4. A method as set forth in claim 2, wherein the load of said engine is an intake air amount per one revolution of said engine.

5. A method as set forth in claim 2, wherein the load of said engine is an intake air pressure of said engine.

6. A method as set forth in claim 2, wherein the load of said engine is a throttle opening of said engine.

7. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

8. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating step comprises the steps of:

increasing said lean skip amount when the output of said downstream-side air-fuel ratio sensor is on the rich side; and decreasing said lean skip amount when the output of said downstream-side air-fuel ratio sensor is on the lean side.

9. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating step comprises the steps of:

increasing said rich skip amount when the output of said downstream-side air-fuel ratio sensor is on the rich side; and decreasing said rich skip amount when the output of said downstream-side air-fuel ratio sensor is on the lean side.

10. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating step comprises the steps of:

increasing said lean skip amount and decreasing said rich skip amount when the output of said downstream-side air-fuel ratio sensor is on the rich side; and decreasing said lean skip amount and increasing said rich skip amount when the output of said downstream-side air-fuel ratio sensor is on the lean side.

11. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the means value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said reference value calculating step comprises the steps of:

calculating a difference between said rich skip amount and said lean skip amount; and calculating said reference value in accordance with said difference.

12. A method for controlling an air-fuel ratio in an internal combustion engine having a catalyst converter for removing pollutants in the exhaust gas thereof, and upstream-side and downstream-side air-fuel fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

13. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating step comprises the steps of:

increasing said lean integration amount when the output of said downstream-side air-fuel ratio sensor is on the rich side; and decreasing said lean integration amount when the output of said downstream-side air-fuel ratio sensor is on the lean side.

14. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating step comprises the steps of:

decreasing said rich integration amount when the output of said downstream-side air-fuel ratio sensor is on the rich side; and increasing said rich integration amount when the output of said downstream-side air-fuel ratio sensor is on the lean side.

15. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating step comprises the steps of:

increasing said lean integration amount and decreasing said rich integration amount when the output of said downstream-side air-fuel ratio sensor is on the rich side; and decreasing said lean integration amount and increasing said rich integration amount when the output of said down-stream-side air-fuel ratio sensor is on the lean side.

16. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter;

calculating a mean value of a number of successive maximum and minimum values of said air-fuel ratio correction amount;

calculating a learning correction amount so that the mean value of said air-fuel ratio correction amount is brought close to a refernce value;

calculating said refernce value in accordance with an air-fuel ratio feedback control parameter; and adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said refernce value calculating step comprises the steps of:

calculating a difference between said rich integration amount and said lean integration amount; and calculating said reference value in accordance with said difference.

17. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for determining whether or not the mean value of said air-fuel ratio correction amount is larger than a variable reference value determined in accordance with an air-fuel ratio feedback control parameter, said reference value corresponding to a stoichiometric air-fuel ratio;

means for increasing a learning correction amount when the mean value of said air-fuel ratio correction amount when the mean value of said air-fuel ratio correction amount is larger than said reference value;

means for decreasing said learning correction amount when the mean value of said air-fuel ratio correction amount is not larger than said reference value; and means for adjusting an actual air-fuel ratio in accordance with said air-fuel ratio correction amount and said learning correction amount.

18. An apparatus as set forth in claim 17, further comprising means for changing said reference value in accordance with a load of said engine.

19. An apparatus as set forth in claim 18, wherein the load of said engine is an intake air amount of said engine.

20. An apparatus as set forth in claim 18, wherein the load of said engine is an intake air amount per one revolution of said engine.

21. An apparatus as set forth in claim 18, wherein the load of said engine is an intake air pressure of said engine.

22. An apparatus as set forth in claim 18, wherein the load of said engine is a throttle opening of said engine.

23. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

24. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating means comprises:

means for increasing said lean skip amount when the output of said downstream-side air-fuel ratio sensor is on the rich side; and means for decreasing said lean skip amount when the output of said downstream-side air-fuel ratio sensor is on the lean side.

25. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating means comprises:

means for increasing said rich skip amount when the output of said downstream-side air-fuel ratio sensor is on the rich side; and means for decreasing said rich skip amount when the output of said downstream-side air-fuel ratio sensor is on the lean side.

26. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said air-fuel ratio feedback control parameter calculating means comprises:

means for increasing said lean skip amount and decreasing said rich skip amount when the output of said down-stream-side air-fuel ratio sensor is on the rich side; and means for decreasing said lean skip amount and increasing said rich skip amount when the output of said down-stream-side air-fuel ratio sensor is on the lean side.

27. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side airfuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side;

wherein said reference value calculating means comprises:

means for calculating a difference between said rich skip amount and said lean skip amount; and means for calculating said refernce value in accordance with said difference.

28. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

29. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter is accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating means comprises:

means for increasing said lean integration amount when the output of said downstream-side air-fuel ratio sensor is on the rich side; and means for decreasing said lean integration amount when the output of said downstream-side air-fuel ratio sensor is on the lean side.

30. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating means comprises:

means for decreasing said rich integration amount when the output of said downstream-side air-fuel ratio sensor is on the rich side; and means for increasing said rich integration amount when the output of said downstream-side air-fuel ratio sensor is on the lead side.

31. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said air-fuel ratio feedback control parameter calculating means comprises:

means for increasing said lean integration amount and decreasing said rich integration amount when the output of said downstream-side air-fuel ratio sensor is on the rich side; and means for decreasing said lean integration amount and increasing said rich integration amount when the output of said downstream-side air-fuel ratio sensor is on the lean side.

32. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio feedback control parameter in accordance with the output of said down-stream-side air-fuel ratio sensor;

means for calculating an air-fuel ratio correction amount in accordance with the output of said upstream-side air-fuel ratio sensor and said air-fuel ratio feedback control parameter;

means for calculating a mean value of a number of successive maximum and minimum values of said air-fuel ratio correction amount;

means for calculating a learning correction amount so that the mean value of said air-fuel ratio correction amount is brought close to a reference value;

means for calculating said reference value in accordance with an air-fuel ratio feedback control parameter; and means for adjusting an actual air-fuel ratio in accordance with said air-fuel ratio correction amount and said learning correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side;

wherein said reference value calculating means comprises:

means for calculating a difference between said rich integration amount and said lean integration amount; and means for calculating said reference value in accordance with said difference.

* * * * *